United States Patent [19]

Rese

[11] 3,955,725

[45] May 11, 1976

[54] KEY HOLDER

[75] Inventor: Arkadijus Rese, Gossau, Switzerland

[73] Assignee: Eberhardt & Co., Germany

[22] Filed: Aug. 30, 1974

[21] Appl. No.: 502,182

[30] Foreign Application Priority Data

Dec. 8, 1973 Germany ..... 2361321

[52] U.S. Cl. ..... 224/5 R; 211/49 D; 70/460

[51] Int. Cl.[2] ..... A45F 5/02

[58] Field of Search ..... 224/26 R, 26 B, 26 K, 224/5 R, 5 A, 5 B; 211/49 D, 59, 49 R; 70/460

[56] References Cited

UNITED STATES PATENTS

| | | | |
|---|---|---|---|
| 1,425,089 | 8/1922 | Henry | 224/26 B UX |
| 1,473,361 | 11/1923 | Tebbetts | 224/26 B UX |
| 1,644,155 | 10/1927 | Scott | 211/59 UX |

FOREIGN PATENTS OR APPLICATIONS

| | | | |
|---|---|---|---|
| 92,222 | 10/1968 | France | 224/26 K |

*Primary Examiner*—Robert J. Spar
*Assistant Examiner*—Jerold M. Forsberg
*Attorney, Agent, or Firm*—Robert E. Burns; Emmanuel J. Lobato; Bruce L. Adams

[57] ABSTRACT

A key holder, especially for keys for locking and unlocking cabins or lockers at a bathing establishment, is adapted to slide onto a receiving bar of an automatic key dispensing machine and is coded, for example by means of a combination of projections and notches, so as to be received only by a particular machine. For example, there may be one machine for keys for men, another for keys for women and still another for keys for children. The key holder is also provided with means for attaching it to the clothing or to the person of a customer.

11 Claims, 2 Drawing Figures

KEY HOLDER

FIELD OF INVENTION:

The present invention relates to a key holder and in particular a holder for a key for opening and locking the cabins of a bathing establishment. The term cabin is herein used in a broad sense to include compartments, dressing rooms, cabanas, lockers and other enclosures provided with locks.

BACKGROUND OF INVENTION:

In the operation of bathing establishments, for example swimming pools or bathhouses, a guest upon entering usually receives a key for a particular dressing room or cabin. This key is given back when the guest leaves the bathing establishment. In order to prevent a guest from losing a key during the bathing time, it has already been proposed to enclose the head of the key in a holder which is provided with a spring loaded member by means of which the key can be clamped onto a bathing suit.

It has also been proposed to dispense keys by means of an automatic key dispensing machine. With known key dispensing machines the return of keys is effected in the manner that the keys are inserted into a return slot whereupon they are scanned or sensed by suitable apparatus in the automatic key machine and are delivered to different individual key storage spaces. It is therefore necessary to provide different storage spaces separated from one another since for example men, women and children are assigned to different dressing areas so that these different groups of guests receive different keys. It will be understood that in some cases still further subdivision may be required. In order to scan or sense the keys and return the individual keys to the proper reservoir or storage space it is necessary to provide more or less expensive mechanism.

SUMMARY OF INVENTION:

It is an object of the present invention to provide a key holder of the above mentioned type which makes it possible for the keys to be dispensed by and returned to an automatic key machine in a simple manner that eliminates the need of expensive sorting apparatus. In accordance with the invention this is achieved by providing the key holder with a slide plate by means of which the key is ejected from the automatic key machine and is returned to the machine without the need of sorting.

The slide plate which can be provided with an identifying number can be formed integrally with the key holder or it can be formed separately and connected to the key holder, for example by a key ring. The slide plate can also be connected directly to the key by means of a key ring.

Advantageously, the key holder is provided with a clip or other means for securing the key to the bathing suit or person of a bather so as to prevent its loss. In the event the slide plate is connected directly to the key, the key ring can be provided with a hook or clasp whereby the key can be secured to the bathing suit. It is also possible to secure the key to the wrist of a bather, for example by means of an arm band that passes through a key ring or through the head of the key.

The slide plate which can be rectangular, triangular, round, oval or any desired shape advantageously has a through opening and a slit connecting the opening with the periphery of the slide plate whereby the slide plate can be slipped onto a return rail of an automatic key machine. The opening is advantageously circular and the return rail is of I-shape cross section. However, the opening can be of other shapes for example square or rectangular. The slide plate is preferably molded of plastic while the return rail of the automatic key machine is preferably metal.

Advantageously, the slide plate is provided with coding means so that it can be slipped onto only a predetermined one of a plurality of return bars. The coding is expeditiously in the form of different projections or notches or a combination of projections and notches formed in a suitable edge surface of the slide plate. Further, the shape of the slide plate itself or also its color can be used as coding means.

DESCRIPTION OF DRAWINGS

The nature and advantages of the invention will be more fully understood from the following description in conjunction with the accompanying drawings which illustrate by way of example an embodiment of the invention.

IN THE DRAWINGS

Figure 1:
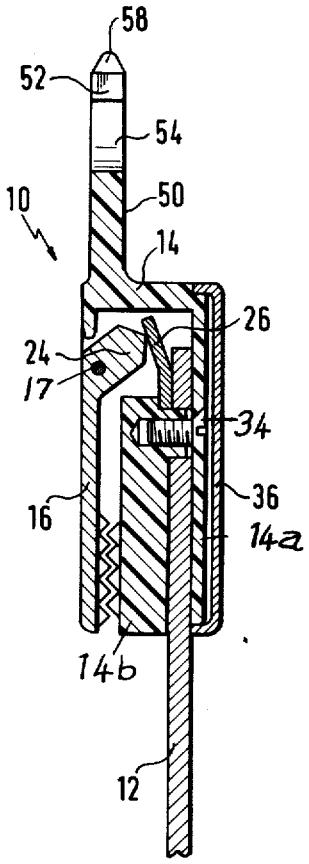
Figure 2:
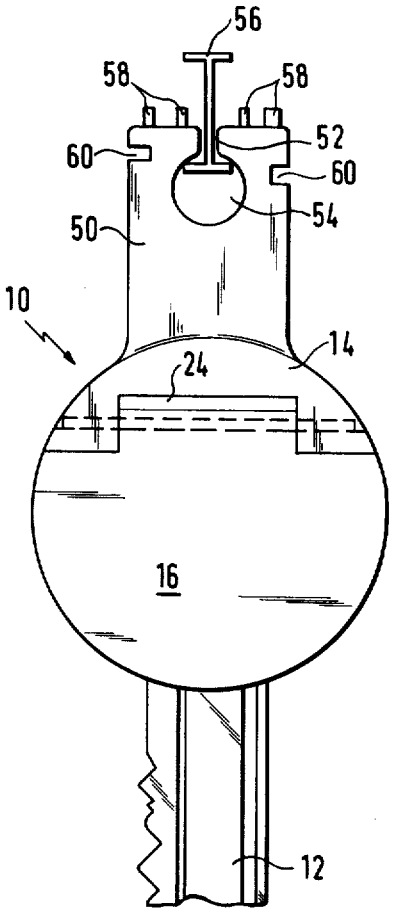

FIG. 1 is a cross section of a key holder in accordance with the invention; and FIG. 2 is a side view of the key holder of FIG. 1 shown schematically on the return rail of an automatic key dispensing machine. The return rail is not shown in FIG. 1.

DESCRIPTION OF A PREFERRED EMBODIMENT

The key holder 10 shown by way of example in the drawings comprises a body portion or casing 14 which can be formed of a suitable plastic, for example by casting or by pressure or injection molding. The holder 10 encloses the head portion of a key 12, for example a key for opening and locking a bathhouse. A snap cover 16 pivotally mounted in the casing 14 by means of a pivot pin 17 is provided on its inner side with transversely extending teeth which are engageable with corresponding teeth provided on the casing 14. The snap cover 16 has an eccentric head portion 24 which cooperates with a leaf spring 26 to press the snap cover to closed position. By means of the snap cover 16 the holder 10 and hence the key 12 can be clamped onto a part of the bathing suit of a guest. The interengaging teeth on the snap cover 16 and the casing 14 assist in gripping a portion of the bathing suit securely.

The casing 14 of the key holder can be of integral construction and can, for example be molded onto the head portion of the key 12. However, in the embodiment illustrated in the drawings, the casing 14 comprises two parts **14*a* and 14*b* which are secured together by means of a screw 34 with the head portion of a key between them. The screw 34 screws into a tapped hole in a boss which is provided on the part 14*b* and fits into a hole provided in the head of the key. It is thus possible to assemble and disassemble the key and key holder expeditiously, for example to change keys or to change key holders. A cover 36 fits over the portion 14*a* of the casing 14 and covers the screw 34**. The cover is suitable secured for example by being a press or snap fit or by adhesive. The cover is suitably formed of metal and carries a key number which can be conveniently applied to the cover by printing or stamping.

As shown by way of example in the drawings, the casing 14 of the key holder 10 is formed with a slide plate 50 having a through bore 54 located centrally near the outer end of the slide plate and a slot 52 which connects the bore 54 with the periphery of the slide plate. The key and the key holder are shown enlarged in the drawings. Instead of being formed integrally with the casing 14 as shown, the slide plate can be formed as a separate part and suitably connected with the casing 14, for example by means of a key ring or chain or the like. In this case the casing 14 and the slide plate 50 are provided with suitable openings to receive the connecting member. It is also possible although less desirable for the slide plate 50 to be connected directly with the key, for example by means of a key ring. In this event the key ring is also preferably provided with a spring hook or the like so that the key can be secured to the bathing suit of a guest.

By virtue of the bore 54 and slot 52 the slide plate 50 can be slid onto a return rail 56 of an automatic key dispensing machine as illustrated in FIG. 2 when the key is to be returned. The return rail 56 is preferably formed of metal and is for example of I-shaped cross section although the cross section can alternatively be of inverted T-shape. The guide rail 56 is inclined and slopes down into the interior of an automatic key dispensing machine (not shown in the drawings) so that when the key is shoved onto the return rail 56 the key together with its holder slides downwardly into the key dispensing machine whereby the return rail 56 forms a reservoir or a magazine for the keys. The automatic key dispensing machine delivers the keys as needed from the opposite end of the return rail 56. In principle, the cross section of the return rail could also be circular but it has been shown that the key holder will not slide as easily on a return rail of circular cross section as on a rail such as that shown in the drawings. It has been found that the wall of the circular bore 54 rests only on the longitudinal edges of the blade of the return rail whereby a good guiding and also a good gliding quality are attained.

The automatic key dispensing machine can be provided with a plurality of return rails 56 which are for example arranged parallel to one another. For example, one rail can be for keys for men, another for women and still another for children. If need be, still other return rails can be provided for example, for schools, clubs or other groups. In other words, the different groups of guests such as men, women or children are assigned to different groups of cabins and the keys belonging to each group of cabins are all stored in one magazine, i.e., are all threaded onto one and the same return rail.

In order to achieve this the slide plates are provided with coding means so that the key holders for any one group of keys can only be threaded onto the proper return rail. As shown by way of example in the drawings, the coding means comprises projections 58 formed on the upper end edge of the slide plate 50 and notches 60 formed in lateral edges of the slide plate. The keys of each group, for example the keys for mens cabins have the same arrangement of projections 58 and notches 60 so that they and only they can be shoved onto one and the same return rail 56. There is of course associated with the guide rail a template or entrance opening having a pattern corresponding to the projections and notches of the slide plates of key holders for a particular group of keys so that those keys and those keys only can be received on the return rail. The keys of another group have another arrangement of projections and notches and are receivable on another return rail provided with a template which corresponds to the arrangement of projections and notches of this other group so that the keys of the last named group can only be shoved onto the last named return rail. Although it is preferred to use a combination of projections and notches as illustrated by way of example in FIG. 2, it will of course be understood that the coding can be carried out by combinations of projections only or by combinations of notches only and that the projections or notches can be provided either on the upper edge or on the lateral edges of the slide plate or both.

While a preferred embodiment of the invention has been shown by way of example in the drawings and is herein particularly described, it will be understood that the invention is in no way limited to this embodiment and that many changes can be made without departing from the spirit of the invention.

What I claim and desire to secure by Letters Patent is:

1. In combination with an automatic key dispensing machine having a plurality of slide rails each of which receives keys at one end and dispenses them from the other end, each said rail having longitudinally extending web and flange portions; a key holder comprising means for securing a key to the key holder, separate means for attaching the key holder to the clothing or person of a customer and a slide plate portion by means of which the key is dispensable by and returnable to said automatic key dispensing machine, said slide plate portion having a through opening to receive said flange portion of one of said rails and a slit connecting said opening with the periphery of said plate to receive said web portion of said rail, whereby the key holder is receivable on said slide rail and slidable to and off of the opposite end of said rail, and said slide plate portion further having coding means cooperating with means associated with respective rails of said machine so as to be receivable on only a predetermined one of said rails said coding means comprising a coded edge configuration of the periphery of said slide plate.

2. A key holder according to claim 1, comprising a body portion integral with said slide plate, said securing means comprising means for securing a key to said body portion.

3. A key holder according to claim 2, in which the means for securing a key to said body portion comprises a second body portion and screw means connecting said body portions with a key sandwiched therebetween.

4. A key holder according to claim 3, comprising a cover secured to said first mentioned body portion and concealing said screw means.

5. A key holder according to claim 4, comprising key identification means on said cover.

6. A key holder according to claim 2, in which said attaching means comprises a snap cover pivotally mounted on said first mentioned body portion and spring biased toward said second body portion to grip a portion of clothing between said snap cover and said second body portion.

7. A key holder according to claim 1, in which said opening is circular and said slide rail is of I-shaped cross section.

8. A key holder according to claim 1, in which said plate portion is of plastic and said slide rail is of metal.

9. A key holder according to claim 1, in which said coding means comprises at least one projection on the peripheral edge of said plate portion.

10. A key holder according to claim 1, in which said coding means comprises at least one recess in the peripheral edge of said plate portion.

11. A key holder according to claim 1, in which said coding means comprises at least one projection on and at least one recess in the peripheral edge of said plate portion.

* * * * *